US009751748B2

(12) United States Patent
Trebbi et al.

(10) Patent No.: US 9,751,748 B2
(45) Date of Patent: Sep. 5, 2017

(54) ZERO WASTE DOSING METHOD AND APPARATUS FOR FILLING CONTAINERS OF LIQUIDS

(71) Applicant: I.M.A Industria Macchine Automatiche S.P.A., Ozzano dell'Emilia (IT)

(72) Inventors: Claudio Trebbi, Medicina (IT); Ivan Ragazzini, Imola (IT)

(73) Assignee: I.M.A Industria Macchine Automatiche S.P.A., Ozzano dell'Emilia (IT)

( * ) Notice: Subject to any disclaimer, the term of this patent is extended or adjusted under 35 U.S.C. 154(b) by 454 days.

(21) Appl. No.: 14/379,611

(22) PCT Filed: Feb. 25, 2013

(86) PCT No.: PCT/IB2013/000275
§ 371 (c)(1),
(2) Date: Aug. 19, 2014

(87) PCT Pub. No.: WO2013/124728
PCT Pub. Date: Aug. 29, 2013

(65) Prior Publication Data

US 2015/0013825 A1 Jan. 15, 2015

(30) Foreign Application Priority Data

Feb. 24, 2012 (IT) ..... MI2012A0281

(51) Int. Cl.

| | |
|---|---|
| ***B65B 1/30*** | (2006.01) |
| ***B67D 7/32*** | (2010.01) |
| ***B67C 3/20*** | (2006.01) |
| ***F04B 43/12*** | (2006.01) |

(52) U.S. Cl.
CPC ..... *B67D 7/3272* (2013.01); *B67C 3/20* (2013.01); *F04B 43/12* (2013.01); *F04B 43/1261* (2013.01)

(58) Field of Classification Search
CPC ..... B67C 3/20; B67D 7/3272; B67D 7/302; F04B 43/12
USPC ..... 222/318
See application file for complete search history.

(56) References Cited

U.S. PATENT DOCUMENTS

| | | | | |
|---|---|---|---|---|
| 5,000,351 | A | 3/1991 | Rudick | |
| 6,393,338 | B1 | 5/2002 | Kemnitz | |
| 7,694,858 | B2 * | 4/2010 | Takeda | B67C 3/045 141/285 |
| 2005/0180856 | A1 | 8/2005 | Bach | |

FOREIGN PATENT DOCUMENTS

| | | | |
|---|---|---|---|
| DE | 19925039 | A1 | 12/2000 |

OTHER PUBLICATIONS

PCT Search Report dated Jul. 2, 2013 of Patent Application No. PCT/IB2013/000275 filed Feb. 25, 2013.

* cited by examiner

*Primary Examiner* — Jason K Niesz
(74) *Attorney, Agent, or Firm* — Maine Cernota & Rardin

(57) ABSTRACT

Zero waste dosing method for filling containers of liquids which provides to use, at a delivery station of the liquid product, at least a volumetric pump with a rotor and stator, associated with a tank of the liquid to be introduced into said containers.

14 Claims, 3 Drawing Sheets

ZERO WASTE DOSING METHOD AND APPARATUS FOR FILLING CONTAINERS OF LIQUIDS

RELATED APPLICATIONS

This application is a national phase application of PCT Application No. PCT/IB2013/000275 filed on Feb. 25, 2013, which claims priority from Italian Application No. MI2012A000281 filed on Feb. 24, 2012. Each of these applications is herein incorporated by reference in their entirety for all purposes.

FIELD OF THE INVENTION

The present invention concerns a method to obtain a zero waste production of containers containing a determinate liquid or mixture of liquids. The invention also concerns a dosing apparatus and a machine that uses such apparatus, which operates according to said method. In particular, the present invention concerns the precision filling of containers with said determinate liquid or mixture of liquids.

BACKGROUND OF THE INVENTION

It is known that containers can be filled with a determinate liquid or mixture of liquids with different levels of tolerance, with regard to the accuracy of the volumetric amount of liquid introduced into the container.

It is also known that, in certain fields in the state of the art, for example, but not only, the pharmaceutical field, the level of tolerance required is always very small.

It is also known that, in the case of very expensive liquids, or particular or special liquids, even dangerous, toxic, poisonous or polluting ones, it is necessary to restrict the filling tolerance to very low values, which can also reach factors of 1-10 per thousand depending on the type of liquid introduced.

Here and hereafter in the description, the word "liquid" should be taken to mean both a liquid substance proper, that is, a fluid substance that retains its own volume in environmental temperature and pressure conditions but tends to deform, assuming the shape of the receptacle, or also a gelatinous or similar substance, having a determinate degree of viscosity which makes it transferable using the appropriate means.

With known filling systems, it is not always possible to obtain the above-mentioned precision and, even when it is obtained, it is not with continuity and constancy, which in any case causes waste production because the tolerances have not been respected.

Such waste not only determines a drop in production and an increase in costs, but also causes problems in reprocessing the containers in order to provide the desired quantity of liquid contained therein.

Furthermore, for liquids that are dangerous, toxic, poisonous or polluting, the reprocessing of the containers creates problems of cost, safety and generally contamination both of the product and of the environment.

Moreover, there are liquids to be transferred that require continuous protection in order to eliminate possible contaminants, insofar as it is possible.

One purpose of the present invention is therefore to perfect a method that allows to prevent waste production at least in relation to expensive or dangerous, toxic, poisonous or polluting liquids, for example used for administration to men, animals or plants.

It goes without saying that said products, in the case of a single use, could also be used for scientific and/or industrial applications.

It is also a purpose to obtain an apparatus that allows to apply said method.

A connected purpose is to perfect a computer program that is suitable to execute and control said method on a machine that comprises said apparatus.

It is also a purpose to obtain a machine for filling containers that uses said apparatus operating according to the method of the present invention and that is managed by the connected computer program.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a method according to the present invention provides to use, at a station for delivering liquid to precision fill determinate containers, a precision volumetric pump associated with a tank or other suitable container of the liquid to be introduced into said containers.

The volumetric pump in question is the type comprising at least a rotor and a possible associated stator, in which is provided the definition of a pumping chamber to progressively determine the pumping of the liquid from an inlet or suction intake to an exit or delivery pipe.

Within the field of the volumetric pumps in question, according to the invention a "zero" angular start-of-delivery position or point is defined, associated with a determinate angular position of at least one rotor, by means of which "zero" point it is possible to control the quantity of liquid delivered so as to have a desired precision dosing.

In particular, in the case of pharmaceutical products or those intended to be protected from polluting or contaminating components, the invention advantageously provides to use a peristaltic pump.

However, it is within the spirit of the invention to apply it also in the case of volumetric pumps, such as gear pumps, lobe pumps or variable chamber pumps.

In the case of a peristaltic pump, it is normally provided with a rotor to which are applied one or more rolls that, as they rotate, continuously and progressively choke an elastic pipe interposed between rotor and stator, in which there is the liquid to be pumped and which functions as a pumping chamber. The continuous and progressive action of the rolls causes the liquid to advance.

Peristaltic pumps are generally used in processes where it is necessary to prevent the components of the pump from coming into contact with the pumped liquid which, as in the present invention, can be dangerous, toxic, poisonous or polluting. Different materials are known, which such elastic pipes are made of.

Normally, volumetric and in particular peristaltic pumps have a discontinuous precision in relation to various factors. Such discontinuities are particularly connected to the normal discontinuous functioning of the pumps, or so-called "start and stop", where each functioning is connected to a univocal cycle of complete delivery. The discontinuous delivery is determined by the fact that it is the quantity of liquid delivered during one functioning cycle that is needed to fill a container with the desired quantity, that is, to deliver the desired quantity of liquid.

The factors that, in a peristaltic pump, are variously shown by a discontinuous delivery process generally comprise: size and thickness of the elastic pipe; the material that makes up the pipe; the size of the pumping chamber between one rotating choke and the previous one; stoppage time; the number of cycles over the unit of time; the characteristics of the fluid transferred.

The Applicant has verified through experimentation, especially in the case of peristaltic pumps, that in the case of a discontinuous delivery ("start and stop"), this uncertainty in the total quantity of liquid delivered can be reduced to very limited values and within the range of the strictest tolerances.

The Applicant then verified that, if the "zero" start-of-delivery point of the rotor is defined with respect to the pipe, the quantity of liquid delivered can be controlled within strict tolerances, even in the range of between 2 and 5 per thousand.

Through an additional variant of the present invention, the Applicant has also confronted and resolved the problem of delivering the liquid connected to the end-of-cycle delivery transitory (after the "stop") and the rotation needed to take the rotor of the volumetric pump to the "zero" start-of-delivery point ("start") that determines an extra-travel angular delivery.

To overcome these problems and eliminate the effect of said transitory, the Applicant has found that it is possible to provide an interception valve, advantageously but not only a three-way valve, or similar or comparable liquid interception member with selection of the passageways, disposed downstream of the outlet pipe of the volumetric pump used.

According to a variant, the valve is positioned very close to the final delivery member that cooperates with the container.

When the desired angular end-of-delivery position ("stop") is reached by the rotor of the volumetric pump, said valve intercepts the stream of liquid normally directed toward the final container in order to divert it into a re-circulation branch which for example re-introduces the liquid intercepted into the original tank or a suitable container.

With the present invention it is possible to satisfy a range of dosed quantities that goes from 0.01 ml to 1,000 ml, in respect of strict tolerances, even in the range of between 2 and 5 per thousand.

It should be noted that the drive of the valve according to the present invention must take into account both the functioning of the valve itself and also the time needed so that the interception occurs precisely in the strictest neighborhood of the desired volume delivered.

It should also be noted here that this method and the connected apparatus allow to create databases associated with the type of product and other possible factors, such as temperature, drift of the components, time between one "stop" and the subsequent "start", etc. The databases are then made both in statistical form and in point-by-point form.

This means that already with the first delivery, both relating to a new product but already delivered previously, and also relating to a new start after a stoppage of a certain entity, it is possible to reach the delivery value within the desired tolerance, because the database supplies the necessary regulation and control parameters.

With the present method and connected apparatus, it is possible to fill several containers simultaneously, with autonomous volumetric pumps dedicated to one container, each of which pumps is associated, downstream of the tank, with its own three-way valve, without needing any individual pre-calibration as in the state of the art.

According to the present invention, there may be a sole delivery station, having an independent measuring station upstream to measure the tare of the containers.

According to a variant, the delivery station may be associated or integrated with a device for measuring the tare of the containers.

However, since a volumetric pump may not keep the delivery constant over time due to problems of drift, which may not be provided in the database, the Applicant has foreseen as a variant that, downstream of the delivery station there is also an individual station for measuring the gross weight of the full containers.

The present invention therefore provides, as an evolutionary variant, the possibility of comparing, using a processing system, a theoretical or expected value of a quantity of liquid, of that specific liquid, to be introduced into the container, memorized in a suitable database associated with the processor, with the value of the actual or real quantity of the specific liquid introduced into the container.

Said comparison derives from the measurement of the tare and of the gross weight after filling.

The invention provides to use the result of this comparison to carry out a closed-ring feedback control of the volumetric pump.

In particular, if from this comparison the real quantity introduced is seen to be less than the theoretical quantity, the angular position associated with the "zero" start-of-delivery point of the regulation and control system is moved backward with respect to the direction of rotation of the rotor. Vice versa, if the real quantity is more than the theoretical quantity, the angular position associated with the "zero" start-of-delivery point is moved forward with respect to the direction of rotation of the rotor.

The angular repositioning value from the "stop" point to the "zero" or start point, or angular compensation travel that is used, is indicated by a and depends on the following function:

$$a=f(q, g, d)$$

where:

q:=unitary quantity of liquid delivered for each angular unit or fraction of angular unit of movement of the "zero" point;

g:=specific weight of the liquid;

d:=value of the individual difference between theoretical quantity and real quantity of liquid delivered as found in the control measurement.

According to an evolutionary variant, the algorithm can be integrated at least with one or more of the following functions: t:=liquid temperature; T:=environmental temperature; D:=factors connected to the drift of components.

According to some execution modes, for the first start-up of the volumetric pump after a stoppage or change of product, thanks to the information in the database connected to the determinate delivery point, the processor can define the value of the individual "zero" point for each pump, in relation to the types of liquid products to be delivered.

According to a variant, the invention provides that, when the flow rate has to be updated, the "zero" point remains fixed and the position of the end-of-delivery point of the desired quantity of liquid is varied.

It is within the spirit of the invention that the control and command system of the delivery cycle, where necessary, intervenes both on the "zero" point and also on the end-of-delivery point.

DESCRIPTION OF THE DRAWINGS

These and other characteristics of the present invention will become apparent from the following description of a possible preferential form of embodiment, given as a non-restrictive example with reference to the attached drawings wherein.

Figure 1:
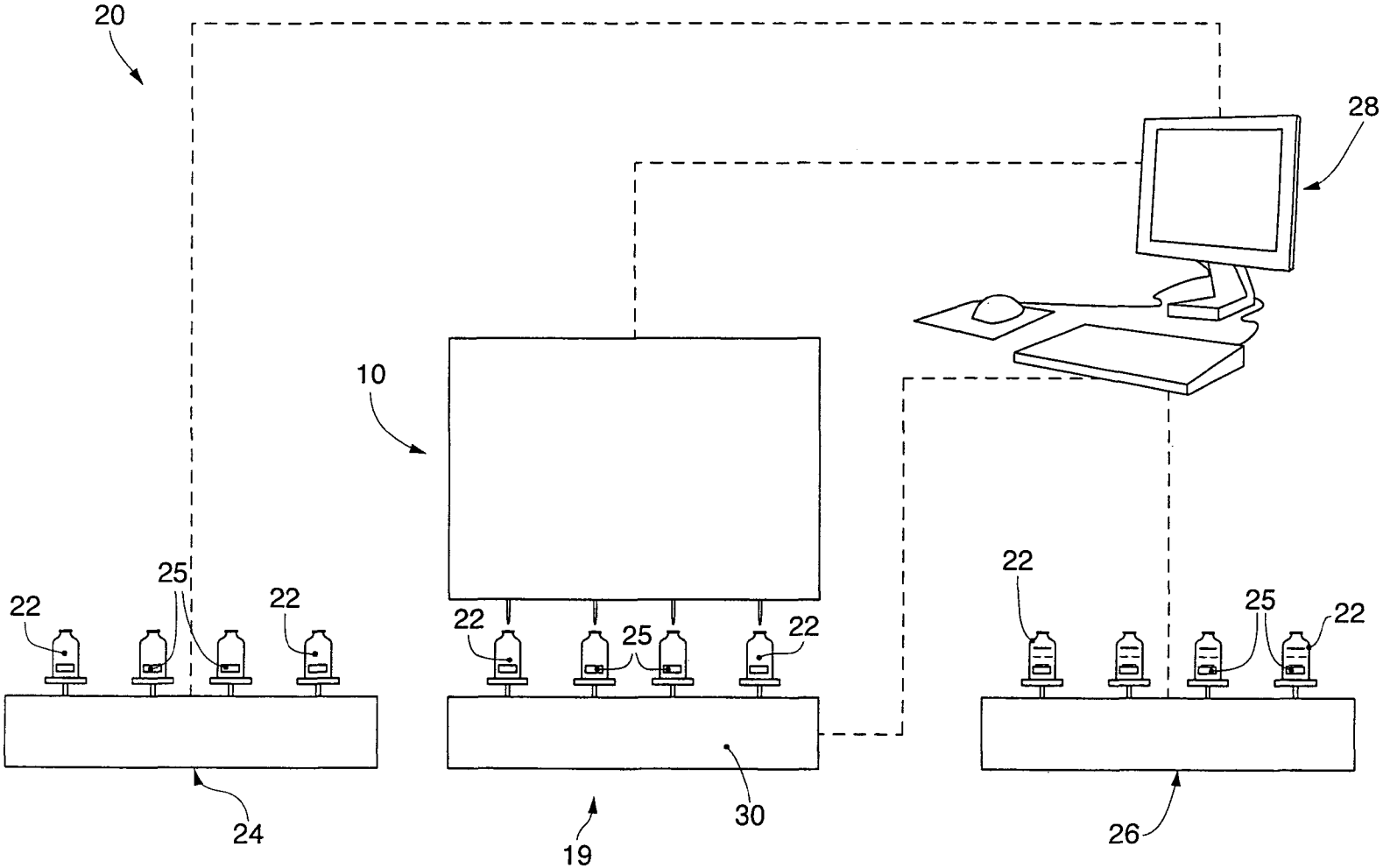
FIG. 1 is a schematic and partial representation of a machine for precision filling of containers with a liquid that comprises an apparatus that operates according to the method of the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION

With reference to the attached drawings, the machine 20 shown by way of example to precision fill a plurality of containers 22 with a liquid or mixture of liquids has a dosing apparatus 10 (FIG. 2), a first station 24 for measuring the tare of the containers 22, which operates upstream, also only with regard to timing, of the step of filling the containers 22, and a second station 26, downstream of the dosing apparatus 10, for measuring the gross weight of the containers 22 after they have been filled.

In one variant, the first station 24 is provided physically separate and independent, upstream of the dosing apparatus 10, as shown for example in FIG. 1. In other variants, the first station 24 is associated or integrated with said dosing apparatus 10.

The machine 20 is also associated with, or comprises, an electronic processor 28, or similar processing means or control and command means, which processor 28 is configured at least to command and control the dosing apparatus 10. Said processor 28 may have an electronic database of pre-memorized data, not shown, depending on the type of liquid to be delivered, which database may be implemented with the point-by-point information obtained.

The dosing apparatus 10 is included in a delivery station 19 and is associated at the lower part with a work plane 30 which supports and positions the containers 22 to be filled, also, possibly, individually.

According to a variant of the invention, the machine 20 is provided with means 25 to univocally identify each individual container 22.

The dosing apparatus 10 (FIG. 2) comprises a tank 11 of liquid, hydraulically coupled with one or more volumetric pumps, in this case peristaltic pumps 12. In the case shown here by way of example, four peristaltic pumps 12 are shown, each dedicated to the precision filling of an associated container 22. However, the number of peristaltic pumps 12 can be varied as a function of the containers to be filled simultaneously, in order to satisfy production requirements, since the ratio between pump and container is always one to one.

Each peristaltic pump 12 is coupled upstream with a first inlet branch 14 for the liquid, which connects the tank 11 with the inlet or suction intake of the peristaltic pump 12, and is connected at delivery or outlet downstream with a delivery member 16, for example a precision nozzle, suitable to introduce, according to a known method, the desired quantity of liquid inside the associated container 22.

According to the present invention, downstream of each peristaltic pump 12 a three-way valve 13 is provided, associated with the delivery member 16. From each three-way valve 13 a second re-circulation branch 15 departs, which leads into the tank 11 or into another suitable container.

Depending on the commands received from the processor 28, the three-way valve 13 is suitable to assume at least a first delivery operating condition and a second re-circulation operating condition. Such two conditions are associated to the point-by-point angular position of the peristaltic pump 12.

In the first delivery operating condition, the three-way valve 13 allows the liquid exiting from the peristaltic pump 12 to pass through the delivery member 16, to fill the container 22 below.

In the second re-circulation operating condition the stream of liquid arriving from the peristaltic pump 12 is intercepted and diverted completely into the second re-circulation branch 15, from where it is again directed inside the tank 11.

Figure 3:
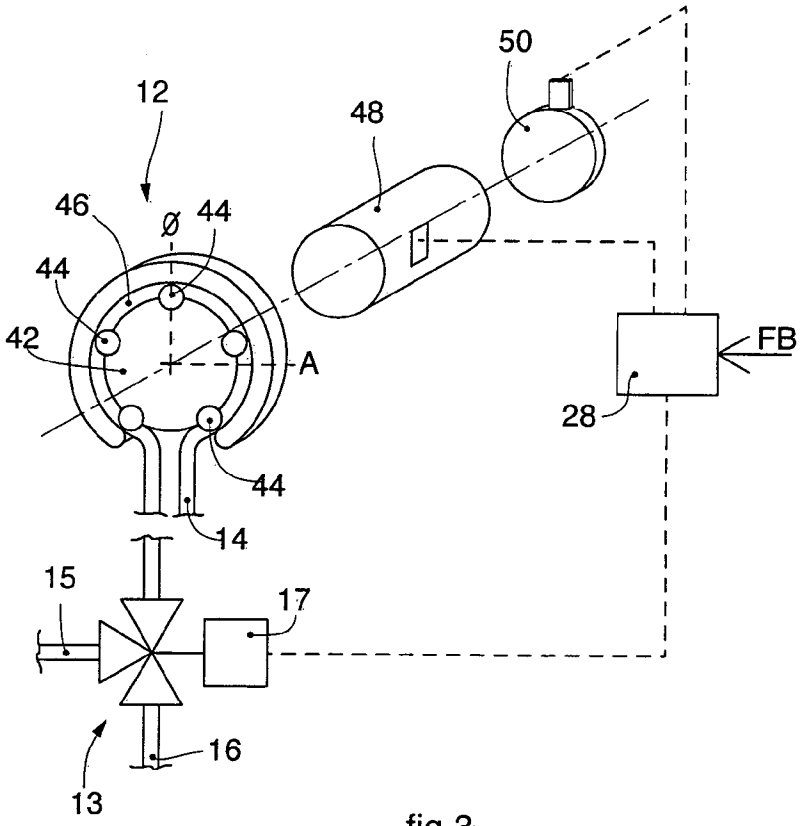
FIG. 3 is a schematic and enlarged detail of a part of the apparatus in FIG. 2.
Figure 2:
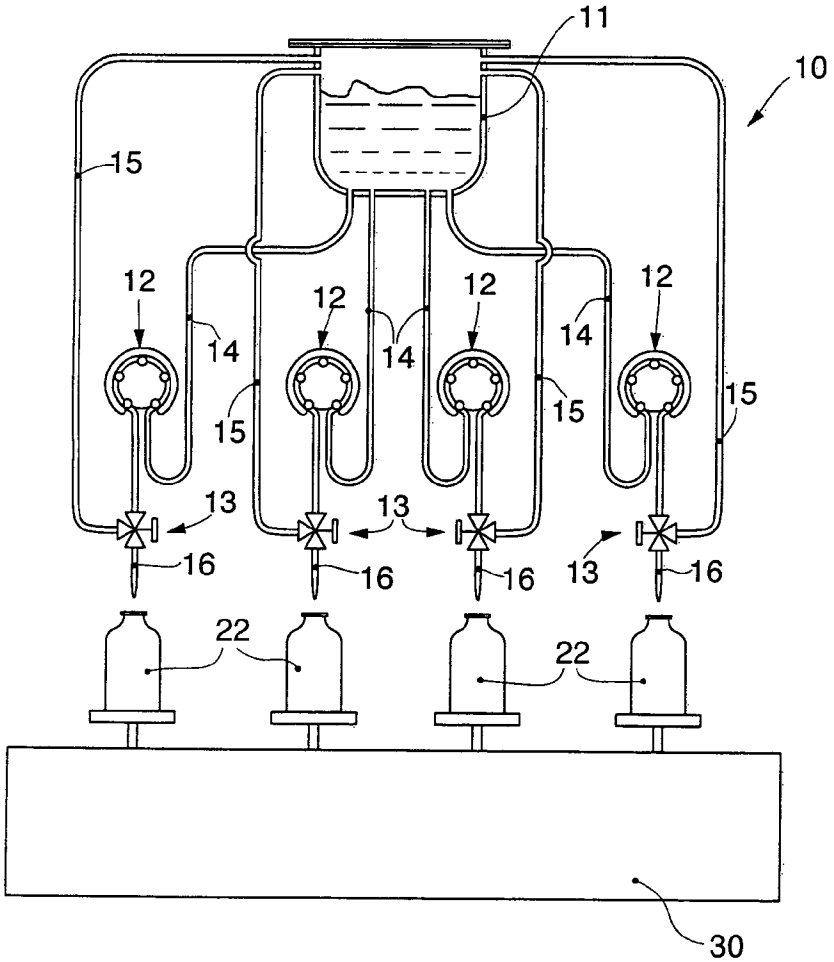
FIG. 2 is a schematic representation of an apparatus that operates according to the method of the present invention.

FIG. 3 shows schematically how the delivery of the liquid is controlled by means of the three-way valve 13 associated with one of the peristaltic pumps 12 shown in FIG. 2.

The peristaltic pump 12 shown comprises, traditionally, a rotor 42 on which a plurality of rolls 44 are mounted which, choking a suitable pipe 46, cause the liquid arriving from the tank 11 to advance. According to a variant, the number of rolls 44 is advantageously comprised between 4 and 10, preferably between 5 and 8. In this case, the rotor 42 is configured to rotate in an anti-clockwise direction. The letter "A" indicates a hypothetical angular end-of-delivery position ("stop") of the filling cycle, while the number "0" indicates a hypothetical point, or "zero" angular start-of-delivery position ("start").

In fact, depending on the quantity of liquid to be delivered, the angle of rotation can vary from a few degrees up to one or more round angles.

At the end of one delivery cycle (position of point "A"—stop) and before starting another one, the peristaltic pump 12 according to the invention must necessarily restore the angular position of the rotor 42 to the point "zero"—start-of-delivery, starting from which the rotation to be imparted to the rotor 42 is again determined, so as to deliver a desired volume of liquid.

The rotor 42 is driven by motorization means controlled in position, in this case by a step motor 48 coupled with a position transducer or encoder 50. The processor 28 commands the functioning of the step motor 48, also as a function of the signals received from the position transducer or encoder 50.

The three-way valve 13 comprises an actuator 17, activated under the control of the processor 28. The actuator 17 determines a desired positioning of the internal interception elements or chokers (not visible in the drawings) of the three-way valve 13 so that the latter can selectively assume at least said first delivery operating condition or second re-circulation operating condition.

In particular, thanks to the position transducer or encoder 50, it is possible to transmit to the processor 28 an electric signal that identifies the position and temporal instant in which the rotor 42, after having completed the angular filling travel reaches the angular position "A" where the filling cycle is stopped.

When the processor 28 receives the signal that indicates that the rotor 42 is approaching the angular position "A", taking into account the delay, it sends the command to the three-way valve 13 to activate it so that in the angular position "A" it is disposed in the second re-circulation operating condition.

This causes the volume of liquid pumped to be diverted into the second re-circulation branch 15, toward the tank 11.

In this way, the volume of liquid pumped in the angular travel from the end-of-delivery point "A", or "stop", to the angular start-of-delivery position "0", or "start", is re-circled to the tank 11 and is not introduced into the container 22, which thus receives only the correct quantity of liquid associated with the functioning cycle.

The second re-circulation operating condition is maintained until the processor 28 receives the signal indicating that the rotor 42 has reached angular position "0" and has therefore stopped there, ready to start the next delivery. Consequently, the three-way valve 13 is again returned to the first delivery operating condition.

The arrow FB in FIG. 3 indicates an electric signal entering the processor 28 that is used for the closed-ring feedback control of the functioning of the peristaltic pump 12 and possibly of the actuator 17.

The signal shown by the arrow FB includes information relating to a differential comparison carried out between a theoretical or expected value of the volume of liquid to be delivered into the container 22 in a determinate work cycle, for example pre-memorized in a database associated with the processor 28, and a real or actual value of volume of liquid delivered into the container 22. This latter value derives from the individual measurements of the weight carried out for each container 22, upstream and downstream of the filling step, at the first station 24 for measuring the tare, and the second station 26 for measuring the gross weight of each container 22 filled.

The value deriving as the result of the differential comparison can in turn be compared with a threshold tolerance value, for example pre-set in the database of the processor 28 and possibly variable depending on the type of liquid to be delivered.

According to the result of the differential comparison received by means of the signal of the arrow FB, possibly compared with said threshold tolerance, the processor 28 conditions the functioning of the peristaltic pump 12 by acting on the step motor 48, varying the angular start-of-delivery position "0" as required.

According to a variant, the end-of-delivery position of the desired quantity of liquid can be conditioned or also modified, and hence the position in which the interception valve starts functioning.

The purpose of varying the angular position of the "zero" point and/or the end-of-delivery point is to reduce, if not eliminate, in subsequent delivery cycles, the difference between theoretical value of the volume of liquid to be delivered and actual value of liquid delivered. This restoration intervention is advantageously performed between one dosing and the next. In other words, the repositioning can be verified continuously, with a predetermined or predeterminable cadence of cycles, that is, a fixed number, from one or more times per total filling cycles.

The repositioning of the peristaltic pump 12 is actuated so as to optimize the cycle time of the dosing apparatus 10 and to keep the stress on the product to be dosed as low as possible.

It should be noted that, to eliminate possible problems of drift or problems connected to the variation in temperature, the processor 28 can intervene also when the command signal both activates and also positions the actuator 17.

Figure 4:
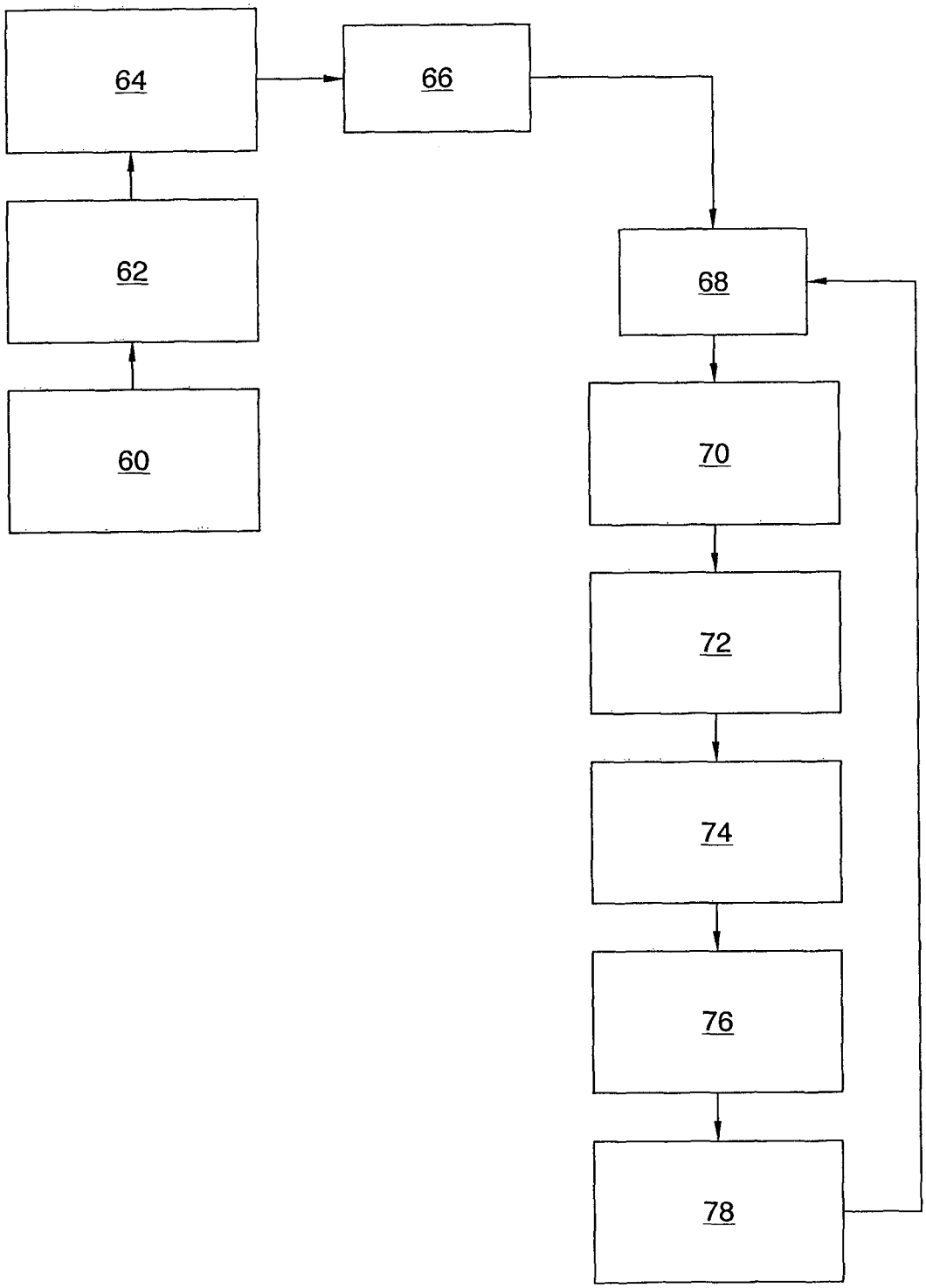
FIG. 4 is a general flow chart of one form of embodiment of the method of the present invention.

In particular, the flow chart in FIG. 4 shows the sequence of steps of the method according to one form of embodiment of the present invention, given as a non-restrictive example of the field of protection.

In the example given here, the flow chart provides a first step, block 60, of initializing the control system, generally by means of the processor 28 which, for example, loads the data and information on the work cycle and the possible data pre-memorized for the positioning of the rotor 42 of the peristaltic pump 12.

Subsequently, a second step, block 62, is provided, in which the rotor 42 reaches the angular start-of-delivery position "0" of the peristaltic pump 12, thanks to a signal deriving from the position transducer or encoder 50.

Then a third step, block 64, is provided, in which the processor 28 loads all the information and parameters available, for example quantity and precision required, on the type of liquid product to be dosed.

Afterward a fourth step, block 66, is provided, in which, by means of the processor 28, a procedure is carried out to calibrate in feedback the peristaltic pump 12, based on the information associated with the signal represented by the arrow FB and possibly a statistical database that takes into account the data archive of the determinate product that is being dosed. This procedure can set and calibrate for the specific product, for example, the angular end-of-delivery position "A", the quantity of liquid to be dosed, the precision required.

At the end of calibration, a fifth step, block 68, is provided, in which the three-way valve 13 is actuated and positioned in the first delivery operating condition thanks to a command from the processor 28.

Then a sixth step, block 70, is provided, in which the processor 28, based on the signal represented by the arrow FB, calculates a possible new value of rotation that must be carried out by the rotor 42 of the peristaltic pump 12.

It is clear that, with every new work session, the first filling cycle is not associated with feedback signals of the specific work session. Therefore, in the case of the first filling cycle, the sixth step can also be carried out possibly based on a statistical database that takes into account the data archive relating to the determinate product being dosed, or may not be carried out. On the contrary, each filling cycle subsequent to the first can take advantage of the feedback control of the same work session in the sixth step.

There is then provided a seventh step, block 72, in which the processor 28 waits to transmit a signal to start the dosing by means of the peristaltic pump 12. A subsequent eighth step, block 74, provides to effect the dosing with the required rotation of the rotor 42 of the peristaltic pump 12, until the angular end-of-delivery position "A" is reached. At this point, a ninth step, block 76, provides to actuate the three-way valve 13 to be positioned in the second re-circulation condition. Finally, a tenth step, block 78, provides to move the rotor 42 of the peristaltic pump 12 from the angular end-of-delivery position "A" to the angular start-of-delivery position "0". Then, as indicated by the arrow that goes from block 78 to block 68, the work cycle is again executed starting from the fifth step of re-positioning the three-way valve 13, to the end of the specific work session.

The method according to the present invention, in its general formulation, as specified in relation to FIG. 4, can be executed by portions of software code of a computer program product, directly loadable inside the memory of a digital computer, in this case the processor 28, when said computer program is executed on a computer.

The invention claimed is:

1. A zero waste dosing method to fill containers of liquids which provides to use, at a delivery station of the liquid product, at least a volumetric pump with a rotor and stator, associated with a tank of the liquid to be introduced into said containers, comprising a step of filling each container, defining a "zero" angular start-of-delivery position of the volumetric pump and an angular end-of-delivery position of the desired quantity of liquid as a function of the "zero" angular position, wherein the "zero" angular position and/or the angular end-of-delivery position of the desired quantity of liquid are controlled and regulated by control and command means configured to re-position the "zero" angular position and/or the angular end-of-delivery position, said method providing to control, by means of selective interception of the liquid delivered downstream of the outlet pipe of the volumetric pump, the desired delivery quantity of the liquid by defining an end-of-cycle delivery transitory through the angular end-of-delivery position.

2. The method as in claim 1, characterized in that after the end-of-cycle delivery transitory an angular delivery extra-travel is defined, determined by the rotation necessary to bring the rotor of the volumetric pump to the "zero" angular start-of-delivery position, in which, when the angular end-of-delivery position is reached by the rotor of the volumetric pump, the stream of liquid directed toward the container in said transitory and along said angular extra-travel is intercepted in order to divert it completely into the tank.

3. The method as in claim 1, characterized in that it provides to identify the position and the temporal instant in which the rotor of the volumetric pump, after having completed the angular travel of desired filling, arrives at the angular end-of-delivery position, and to completely recirculate in the tank the volume of liquid pumped in the angular travel from the angular end-of-delivery position to the "zero" angular start-of-delivery position.

4. The method as in claim 1 hereinbefore, characterized in that it provides to carry out individual measurements of the weight of each container, upstream and downstream of the filling step, in order to calculate a real or actual value of the volume of liquid delivered into the container and to carry out a differential comparison between a theoretical or expected value of the volume of liquid to be delivered into the container in a determinate work cycle and said real or actual value of the volume of liquid delivered into the container and to control, by varying or restoring the "zero" angular start-of-delivery position and/or the angular end-of-delivery position of the desired quantity of liquid, in closed-ring feedback in order to condition the functioning of the volumetric pump by means of a feedback signal which includes information relating to said differential comparison.

5. The method as in claim 1, characterized in that it provides to condition the selective interception of the liquid delivered downstream of the outlet pipe of the volumetric pump by means of said feedback signal.

6. The method as in claim 4, characterized in that it comprises a step in which the rotor of the volumetric pump reaches the "zero" angular start-of-delivery position, a step in which information and parameters on the type of liquid product to be dosed and/or on the product to be dosed are made available, a feedback calibration step on the volumetric pump, based on the information associated with the feedback signal and possibly of a statistical database, a fifth step of actuating a delivery condition of the product, a sixth step of calculating a possible new rotation value which must be carried out by the rotor of the volumetric pump on the basis of the feedback signal, a step of actuating the rotor of the volumetric pump for the dosage of the liquid product, until the angular end-of-delivery position is reached, a step of actuating, once the angular end-of-delivery position is reached, a condition of re-circulating the liquid product and a step which provides to move the rotor of the volumetric pump from the angular end-of-delivery position again to the "zero" angular start-of-delivery position.

7. A zero waste dosing apparatus to fill containers of liquids comprising at least a tank of liquid hydraulically coupled to at least one volumetric pump, characterized in that at least one of said volumetric pumps is configured to define a "zero" angular start-of-delivery position associated with a determinate angular position of a rotor of the at least one volumetric pump with respect to a pumping chamber of the liquid provided between rotor and stator and to define an angular end-of-delivery position of the desired quantity of liquid, a delivery extra-travel being provided, not connected with the introduction of the liquid into the containers, said apparatus being operatively associated with control, testing and command means which condition the "zero" angular position and/or the angular end-of-delivery position.

8. The apparatus as in claim 7, wherein said at least one volumetric pump is coupled upstream with a first inlet branch of the liquid, which connects the tank with the inlet of the volumetric pump, and connected downstream with a delivery member, suitable to introduce the desired quantity of liquid inside an associated container, characterized in that, downstream of said at least one volumetric pump a liquid interception mean is provided with selection of the passageways associated with the delivery member configured to receive the liquid from the first inlet branch, a second re-circulation branch, which leads into the tank, being associated with said liquid interception mean, said liquid interception mean being associated with the end of delivery of the desired quantity of liquid.

9. The apparatus as in claim 7, characterized in that said at least one volumetric pump is a peristaltic pump.

10. The apparatus as in claim 8, characterized in that it is associated with processing means configured to condition the liquid interception mean so that said liquid interception mean assumes at least a first delivery operating condition and a second re-circulation operating condition, wherein, in the first delivery operating condition the liquid interception mean allows the passage of the liquid exiting from the volumetric pump through the delivery member, in order to fill the container, and in the second re-circulation operating condition the stream of liquid coming from the volumetric pump is intercepted and diverted completely into the second re-circulation branch, from where it is directed again inside the tank.

11. The apparatus as in claim 10, characterized in that the liquid interception mean can be conditioned by means of a feedback signal deriving from a differential comparison between a theoretical or expected value of the volume of liquid to be delivered into the container in a determinate work cycle and a real or actual value of the volume of liquid delivered into the container.

12. The machine to fill, with precision, a plurality of containers using a liquid or mixture of liquids comprising a dosing apparatus according to claim 7.

13. The machine as in claim 12, characterized in that it comprises a first station to measure the tare of the containers, configured to operate upstream, at least in timing, of the step of filling the containers, and a second station, downstream of the dosing apparatus, to measure the gross weight of the containers after they have been filled, so as to determine, with a differential calculation with respect to the value of weight of the tare, the quantity of liquid actually delivered into the container, said machine also comprising processing means configured at least to command and control the dosing apparatus on the basis of both data pre-memorized in a suitable electronic database, as a function of the type of liquid to be delivered, and also on the basis of point-by-point information obtained from the first station and from the second station.

14. The machine as in claim 13, characterized in that the processing means are configured to condition the functioning of the volumetric pump using a feedback signal deriving from the differential comparison between a theoretical or expected value of the volume of liquid to be delivered into the container in a determinate work cycle obtained from the first station, and a real or actual value of the volume of liquid delivered into the container obtained from the second station wherein the processing means are configured to condition the functioning of the liquid interception mean by means of said signal.

* * * * *